US006799867B1

(12) United States Patent
Cheng

(10) Patent No.: US 6,799,867 B1
(45) Date of Patent: Oct. 5, 2004

(54) TWINKLING LIGHT STRING

(76) Inventor: Hung-Huei Cheng, 2F, No. 99, Sec. 4, Chueng Hsieng North Road, Taipei (TW)

( * ) Notice: Subject to any disclaimer, the term of this patent is extended or adjusted under 35 U.S.C. 154(b) by 0 days.

(21) Appl. No.: 10/600,425

(22) Filed: Jun. 23, 2003

(51) Int. Cl.[7] ..... F21V 21/00

(52) U.S. Cl. ..... 362/249; 362/226; 362/806; 362/252; 439/619; 439/699.2

(58) Field of Search ..... 362/226, 806, 362/252, 249; 439/619, 699.2, 699.1

(56) References Cited

U.S. PATENT DOCUMENTS 5,707,138 A * 1/1998 Pan ..... 362/226
5,720,544 A * 2/1998 Shu ..... 362/226
5,887,967 A * 3/1999 Chang ..... 362/226
6,135,614 A * 10/2000 Chen ..... 362/226
6,474,841 B1 * 11/2002 Rahman ..... 362/252
6,595,657 B1 * 7/2003 Shieh ..... 362/226

* cited by examiner

*Primary Examiner*—Thomas M. Sember
(74) *Attorney, Agent, or Firm*—Rosenberg, Klein & Lee

(57) ABSTRACT

The present invention relates to a twinkling light string, which includes a main wire and several branch strings. Each branch string in interval is provided with a first bulb assembly or a second bulb assembly, wherein one bulb holder can and only can be connected with a related socket of the same bulb assembly. The bulb assembly can be easily differentiated by an outside convex beam on the socket.

2 Claims, 3 Drawing Sheets

TWINKLING LIGHT STRING

BACKGROUND OF THE INVENTION

A conventional twinkling light string includes a main wire connecting with several branch strings, wherein each branch string is provided several bulb assemblies. Every bulb assembly connected on a first string has the same structure, which is different from the bulb assembly on a nearby second string. Hence, the twinkling light string can effectively twinkle in use.

In order to obtain the above purpose, a known structure, such as U.S. Pat. No. 6,474,841, provides two kinds of bulb assemblies for use. It includes a standard bulb assembly and a non-standard bulb assembly being larger than the standard bulb for connecting with different branch strings in interval. When assembling the two kinds of bulb assemblies, it will be very trouble in differentiating them.

Accordingly, the present invention is to provide a twinkling light string, which is provided with two kinds of improved bulb assemblies while the bulb assemblies can be differentiated easily and assembled.

BRIEF DESCRIPTION OF TEE DRAWINGS

The following drawings indicate the character and improvement of the present invention.

DETAILED DESCRIPTION OF THE INVENTION

Figure 2:
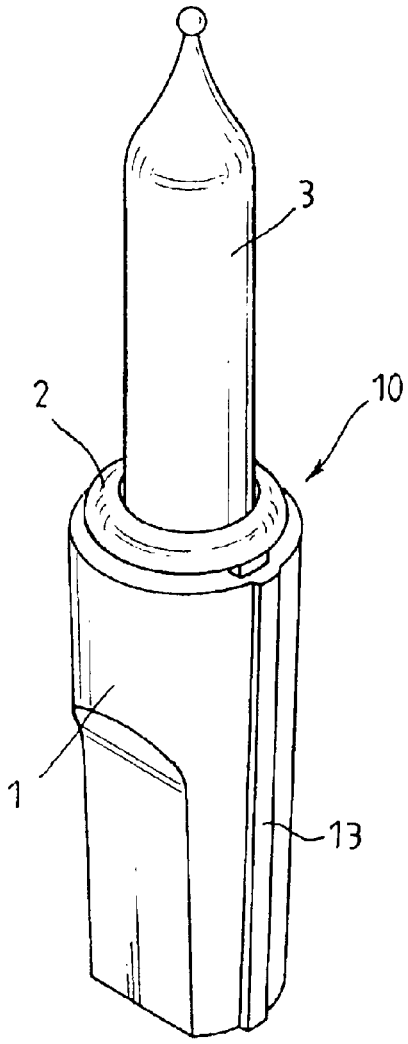
FIG. 2 shows an assembled perspective view of FIG. 1.
Figure 1:
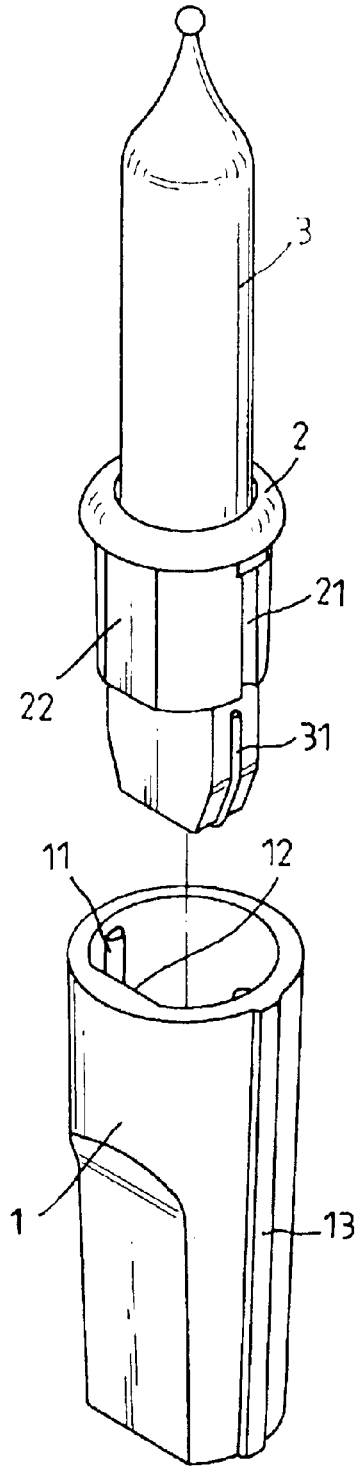
FIG. 1 is an exploded perspective view of a first bulb assembly according to the present invention.

Referring firstly to FIGS. 1 and 2, it discloses a first bulb assembly (10) according to the present invention, which includes a socket (1), a bulb holder (2), and a bulb (3). The holder (2) is provided with a groove (21) at both sides relating to the direction where the conductive wire (31) of the bulb (3) is folded. At a perpendicular side relating to the groove (21) of the holder (2) is formed a plane portion (22). In the socket (1) relating to the position of the groove (21) of the holder (2), a convex portion (11) is provided. A plane (12) is formed in the socket (1) relating to the plane portion (22) of the holder (2). Hence, the holder (2) can and only can be connected with the socket (1) effectively. An outside convex beam (13) is capable of being formed for easily differentiating.

Figure 4:
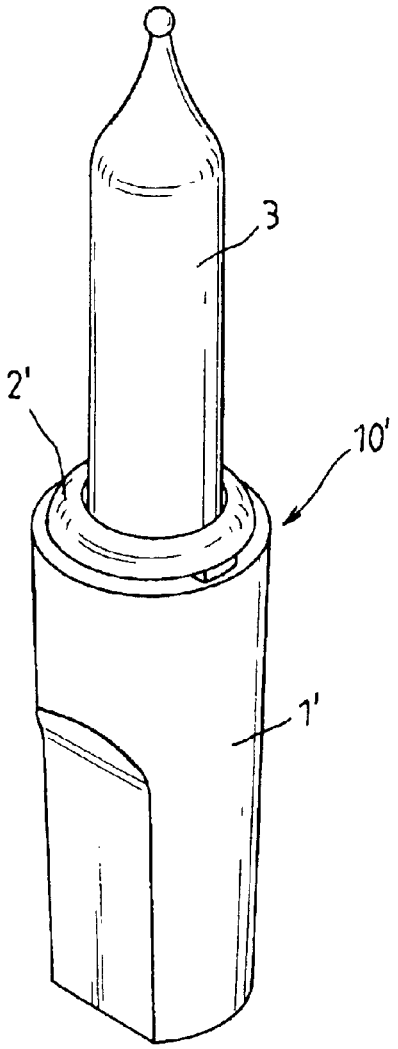
FIG. 4 shows an assembled perspective view of FIG. 5.
Figure 3:
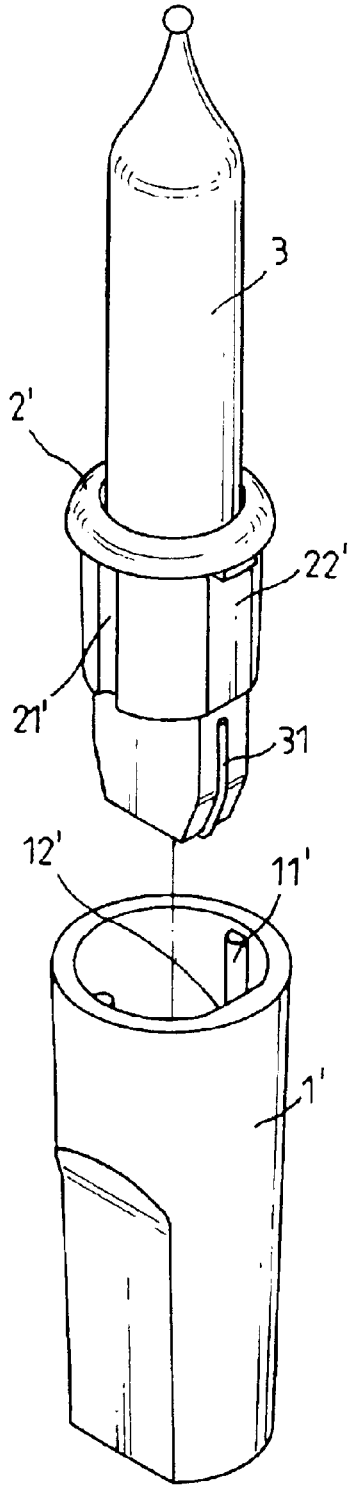
FIG. 3 is an exploded perspective view of a second bulb assembly according to the present invention.

Referring to FIGS. 3 and 4, it discloses a second bulb assembly (10') according to the present invention, which includes a socket (1'), a bulb holder (2'), and a bulb (3). The holder (2') is provided with a groove (21') at both sides perpendicular to the direction where the conductive wire (31) of the bulb (3) is folded. At one side relating to the direction of the conductive wire (31) of the bulb (3) being folded, a plane portion (22) is provided. In the socket (1') relating to the positions of the grooves 25 (21') of the holder (2'), the convex portions (11') are provided. A plane (12') is formed in the socket (1') relating to the plane portion (22') of the holder (2'). Hence, the holder (2') can and only can be connected with the socket (1') effectively.

From above description, it can be found that the bulb holder (2) of the first bulb assembly (10) can and only can connect with the socket (1) of the first bulb assembly (10) and cannot be inserted into the socket (1') of the second bulb assembly (10'). On the other hand, the bulb holder (2') of the second bulb assembly (10') can and only can connect with the socket (1') of the second bulb assembly (10') and cannot be inserted into the socket (1) of the first bulb assembly (10). Hence, the assembling of the two kinds of bulb assemblies will never be mistaken. Further, the assembled bulb assembly can be easily differentiated based on the convex beam (13) only formed on the first bulb assembly (10).

Figure 5:
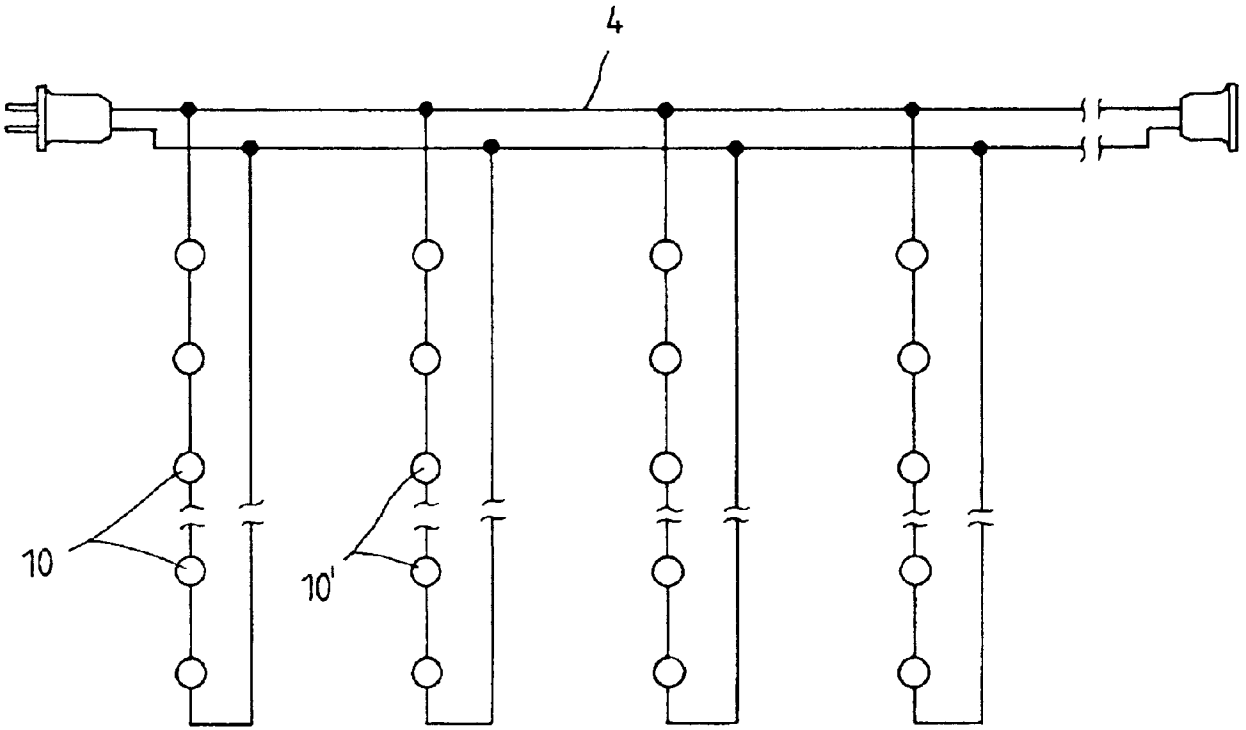
FIG. 5 is a schematic view of a twinkling light string according to the present invention.

In application, as shown in FIG. 5, the twinkling light string includes a main wire (4) and several branch string. The first branch string can be provided with the first bulb assemblies (10) while the second branch string can be provided with the second bulb assemblies (10'), etc. So the twinkling light string according to the present invention obtains the predicted objective while the use of the designed two bulb assemblies.

Accordingly, the present invention obtains utility for use and should be allowed for patent.

What is claimed is:

1. A twinkling light string comprising:

a main wire and several branch strings, wherein one branch string is provided with a first bulb assembly and a nearby branch string is provided with a second bulb assembly;

said first bulb assembly including a socket, a bulb holder, and a bulb, wherein the holder is provided with a groove at both sides relating to the direction where the conductive wire of the bulb is folded, said holder further having a perpendicular planar side relating to the groove of the holder;

said socket having a plane and a convex portion; wherein when said holder is fitted in socket the convex and plane portions mate with the grooves and planar side of the holder;

the second bulb assembly including a socket, a bulb holder, and a bulb, wherein the second holder is provided with a groove at both sides perpendicular to the direction where the conductive wire of the second bulb is folded; said second holder further having a planar side relating to the direction of the conductive wire of the second bulb being folded; said second socket having a plane and a convex portion; wherein when said second holder is fitted in the second socket the convex and plane portions mate with the grooves and planar side of the second holder.

2. The twinkling light of claim 1 further comprising an outside convex beam being formed on the socket.

* * * * *